US010801776B2

(12) United States Patent
Asada et al.

(10) Patent No.: US 10,801,776 B2
(45) Date of Patent: Oct. 13, 2020

(54) DRYING DEVICE AND RECORDING MEDIUM DRYING SYSTEM

(71) Applicant: RICOH COMPANY, LTD., Tokyo (JP)

(72) Inventors: Kohki Asada, Kanagawa (JP); Kazuhiro Wakamatsu, Kanagawa (JP); Genichiro Kawamichi, Kanagawa (JP); Ken Onodera, Kanagawa (JP); Toshihiro Yoshinuma, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 448 days.

(21) Appl. No.: 15/040,463

(22) Filed: Feb. 10, 2016

(65) Prior Publication Data

US 2016/0273832 A1 Sep. 22, 2016

(30) Foreign Application Priority Data

Mar. 16, 2015 (JP) ..... 2015-052174

(51) Int. Cl.
*F26B 3/20* (2006.01)
*B41J 11/00* (2006.01)
(Continued)

(52) U.S. Cl.
CPC ..... *F26B 3/20* (2013.01); *B41J 11/002* (2013.01); *F26B 13/08* (2013.01); *F26B 13/18* (2013.01);
(Continued)

(58) Field of Classification Search
None
See application file for complete search history.

(56) References Cited

U.S. PATENT DOCUMENTS 3,503,139 A * 3/1970 Mahoney ..... D21F 5/02 34/111
5,350,896 A * 9/1994 Amico ..... G03G 15/2003 219/216
(Continued)

FOREIGN PATENT DOCUMENTS

JP H08-220927 A 8/1996
JP 2001-305906 11/2001
(Continued)

OTHER PUBLICATIONS

European search report dated Aug. 18, 2016 in corresponding European Patent Application No. 16157186.4.
(Continued)

*Primary Examiner* — Alejandro Valencia
(74) *Attorney, Agent, or Firm* — Oblon, McClelland, Maier & Neustadt, L.L.P.

(57) ABSTRACT

A drying device including multiple heating rollers to dry a recording medium wound around the heating rollers while conveying the recording medium is provided. The heating rollers include upstream heating rollers and downstream heating rollers, disposed on an upstream side and a downstream side, respectively, relative to a direction of conveyance of the recording medium. Each of the upstream heating rollers includes an upstream heat source. Each of the downstream heating rollers includes a downstream heat source. The upstream heat source and the downstream heat source have different configurations. The upstream heat source has a maximum amount of current greater than that of the downstream heat source.

14 Claims, 6 Drawing Sheets

(51) Int. Cl.
*G03G 15/16* (2006.01)
*F26B 13/08* (2006.01)
*F26B 13/18* (2006.01)

(52) U.S. Cl.
CPC ..... *G03G 15/1695* (2013.01); *G03G 2215/00666* (2013.01)

(56) References Cited

U.S. PATENT DOCUMENTS

| | | | | |
|---|---|---|---|---|
| 8,606,135 | B2 * | 12/2013 | Yamashina | G03G 15/205 399/67 |
| 2003/0103778 | A1 * | 6/2003 | Meads | G03G 15/205 399/88 |
| 2011/0267393 | A1 | 11/2011 | Okamoto | |
| 2012/0230719 | A1 * | 9/2012 | Matsumoto | G03G 15/2042 399/69 |
| 2013/0293617 | A1 * | 11/2013 | Suzuki | B41J 11/002 347/16 |
| 2014/0232797 | A1 | 8/2014 | Onodera et al. | |
| 2015/0174921 | A1 | 6/2015 | Onodera et al. | |
| 2015/0346659 | A1 * | 12/2015 | Nagayama | G03G 15/2039 101/424.1 |

FOREIGN PATENT DOCUMENTS

| | | | |
|---|---|---|---|
| JP | 2002-169409 | A | 6/2002 |
| JP | 2002-287564 | | 10/2002 |
| JP | 2002-296951 | A | 10/2002 |
| JP | 2003-177621 | A | 6/2003 |
| JP | JP2004-276437 | | 10/2004 |
| JP | 2007-062156 | A | 3/2007 |
| JP | 2009-154368 | A | 7/2009 |
| JP | 2013-092715 | | 5/2013 |
| JP | 2014-177102 | | 9/2014 |

OTHER PUBLICATIONS

Japanese Office Action dated Jan. 4, 2019 in Japanese Patent Application No. 2015-052174 (3 pages).

* cited by examiner

DRYING DEVICE AND RECORDING MEDIUM DRYING SYSTEM

CROSS-REFERENCE TO RELATED APPLICATIONS

This patent application is based on and claims priority pursuant to 35 U.S.C. § 119(a) to Japanese Patent Application No. 2015-052174, filed on Mar. 16, 2015, in the Japan Patent Office, the entire disclosure of which is hereby incorporated by reference herein.

BACKGROUND

Technical Field

The present disclosure relates to a drying device and a recording medium drying system.

Description of the Related Art

Drying devices for drying a recording medium to which ink or a pretreatment liquid is applied are known. Such drying devices employ multiple heating rollers each containing a heat source, such as a halogen lamp.

SUMMARY

In accordance with some embodiments of the present invention, a drying device is provided. The drying device includes multiple heating rollers to dry a recording medium wound around the heating rollers while conveying the recording medium. The heating rollers include upstream heating rollers and downstream heating rollers, disposed on an upstream side and a downstream side, respectively, relative to a direction of conveyance of the recording medium. Each of the upstream heating rollers includes an upstream heat source. Each of the downstream heating rollers includes a downstream heat source. The upstream heat source and the downstream heat source have different configurations. The upstream heat source has a maximum amount of current greater than that of the downstream heat source.

In accordance with some embodiments of the present invention, a recording medium drying system is provided. The system includes a pretreatment device to apply an ink or a pretreatment liquid to a recording medium, and the above drying device to dry the recording medium. The drying device is disposed downstream from the pretreatment device relative to the direction of conveyance of the recording medium.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
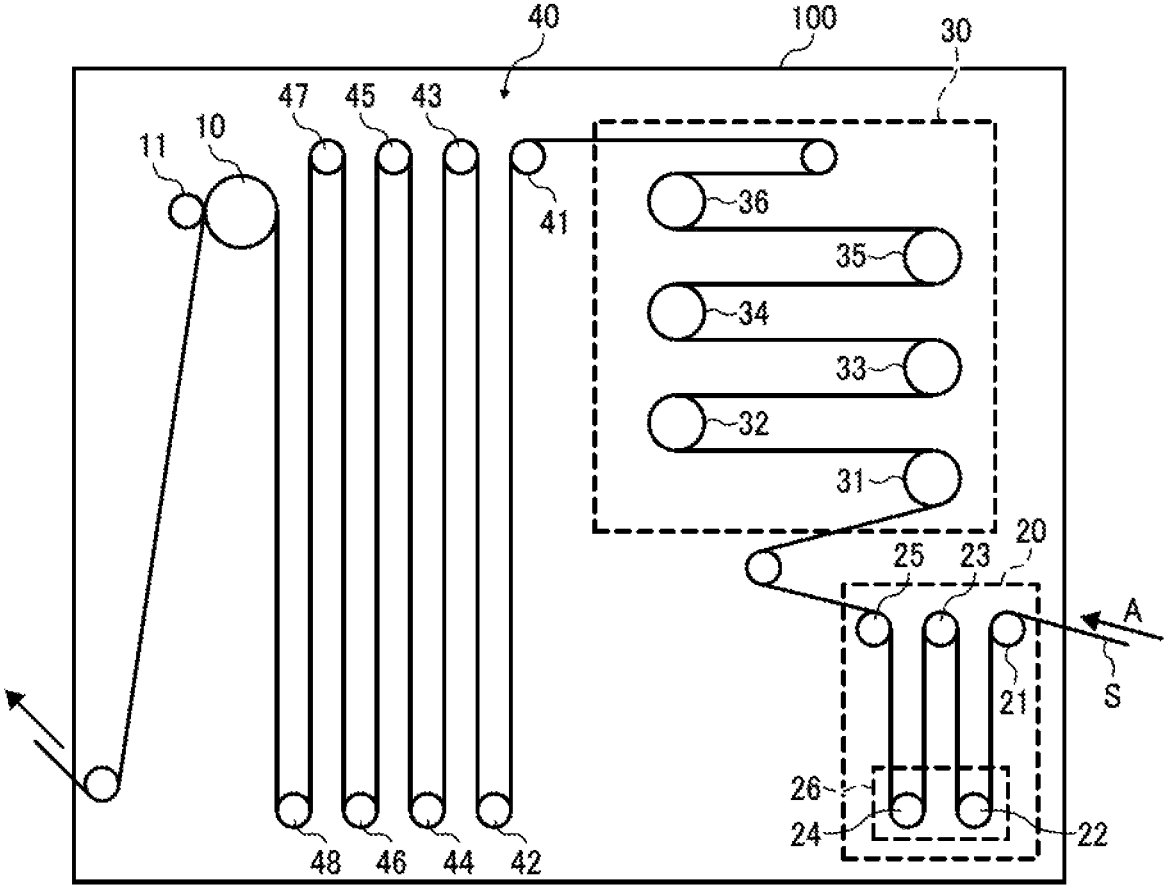
FIG. 1 is a schematic view of a drying device according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In drying devices employing multiple heating rollers, heating rollers disposed on an upstream side relative to the direction of conveyance of recording medium (hereinafter "upstream heating rollers") require a large amount of heat supply to raise the temperature of the recording medium. By contrast, heating rollers disposed on a downstream side relative to the direction of conveyance of recording medium (hereinafter "downstream heating rollers") only have to maintain the temperature of the recording medium heated and conveyed by the upstream heating rollers. Thus, the downstream heating rollers only have to supply a smaller amount of heat to the recording medium compared to the upstream heating rollers.

Even if all the multiple heating rollers have the same heat source configuration, the upstream heating rollers should supply a great amount of heat with high power output.

By contrast, the downstream heating rollers only have to supply a small amount of heat to the recording medium. This can be achieved by lowering a lighting rate of the heat source in the downstream heating rollers. Here, the lighting rate is defined as a ratio of the amount of current actually flowed in the heat source to the maximum amount of current flowable in the heat source.

However, there is a problem that when the lighting rate of the heat source is excessively lowered, the lifespan of the heat source (e.g., halogen lamp) is disadvantageously shortened.

In accordance with an embodiment of the present invention, a drying device including multiple heating rollers which can supply a proper amount of heat is provided.

FIG. 1 is a schematic view of a drying device 100 according to an embodiment of the present invention.

The drying device 100 includes a conveyance roller 10 for conveying a sheet S (serving as a recording medium) disposed on a downstream side relative to a sheet conveyance direction. The conveyance roller 10 conveys the sheet S in a direction indicated by arrow A in FIG. 1.

The drying device 100 further includes a buffer part 20, a sheet drying part 30, and a sheet cooling part 40.

The buffer part 20 is disposed on an upstream side in the drying device 100 relative to the sheet conveyance direction. The buffer part 20 secures a predetermined amount of buffer in the vicinity of the inlet port of the drying device 100. The buffer part 20 includes multiple rollers 21, 22, 23, 24, 25, and 26 (hereinafter collectively "rollers 21 to 26") to which the sheet S is wound around. The rotation speed of the conveyance roller 10 is variable-controlled so as to secure the predetermined amount of buffer when the conveyance roller 10 conveys the sheet S. Thus, the conveyance roller 10 conveys the sheet S at a constant speed. Among the rollers 21 to 26, the two rollers 22 and 24, disposed at a lower part of the drying device 100, are movable up and down. The amount of buffer is variable by varying the positions of the two rollers 22 and 24.

The sheet S is conveyed from the buffer part 20 to the sheet drying part 30.

The sheet drying part 30 includes multiple heating rollers 31, 32, 33, 34, 35, and 36 (hereinafter collectively "heating rollers 31 to 36") arranged in a zigzag manner and to which the sheet S is wound around. Each of the heating rollers 31 to 36 contains a halogen lamp (serving as a heat source) inside. Each of the heating rollers 31 to 36 transfers heat to the sheet S by contact with the sheet S, thereby drying the sheet S.

Among the heating rollers 31 to 36, those disposed on an upstream side relative to the sheet conveyance direction (hereinafter "upstream heating rollers") require a greater ability of heating the sheet S than the others disposed downstream therefrom. This is because heat from the upstream heating rollers is drawn by the sheet S without being supplied to ink on the sheet S.

When the sheet S is heated to a predetermined temperature or above by heat from the upstream heating rollers, heat from the heat rollers 33, 34, 35, and 36, disposed on a downstream side from the upstream heating rollers relative to the sheet conveyance direction (hereinafter "downstream heating rollers 33 to 36"), is used for drying ink on the sheet S.

The number of heating rollers in the sheet drying part 30 is six. In this case, two of the heating rollers disposed on an upstream side relative to the sheet conveyance direction, i.e., the upstream heating rollers 31 and 32, are given an ability for sufficiently heating the sheet S. Detailed configurations of the upstream heating rollers 31 and 32 and the downstream heating rollers 33 to 36 are described later.

The halogen lamps contained in the heating rollers 31 to 36 are controlled by a PC (personal computer) 50, serving as a controller, to be described later.

The sheet drying part 30 has an enclosed space. The internal heat of the sheet drying part 30 is thermally insulated by a heat insulating material disposed around the sheet drying part 30, so as not to leak to the outside of the sheet drying part 30. Owing to this configuration, the internal space of the chamber of the sheet drying part 30 has a temperature higher than that of the surrounding area of the sheet drying part 30.

As the space within the chamber is heated by heat generated from the heating rollers, in each space between the heating rollers 31 to 36, the sheet S is allowed to dry owing to heat transfer caused by convection of high-temperature air. Therefore, a heater exclusive for heating the internal space is needless.

The sheet S is then conveyed from the sheet drying part 30 to the sheet cooling part 40.

The sheet cooling part 40 includes multiple guide rollers 41, 42, 43, 44, 45, 46, 47, and 48 (hereinafter collectively "guide rollers 41 to 48") arranged in a zigzag manner and to which the sheet S is wound around. The sheet S conveyed from the sheet drying part 30 is cooled while being conveyed between the guide rollers 41 to 48.

Within the space of the sheet cooling part 40, the temperature of the sheet S is controllable by means of blowing of external air or changing of the conveyance distance.

The sheet S conveyed from the sheet cooling part 40 is passed through a nip between the conveyance roller 10 and a nip roller 11 and conveyed to the outside of the drying device 100.

Figure 2:
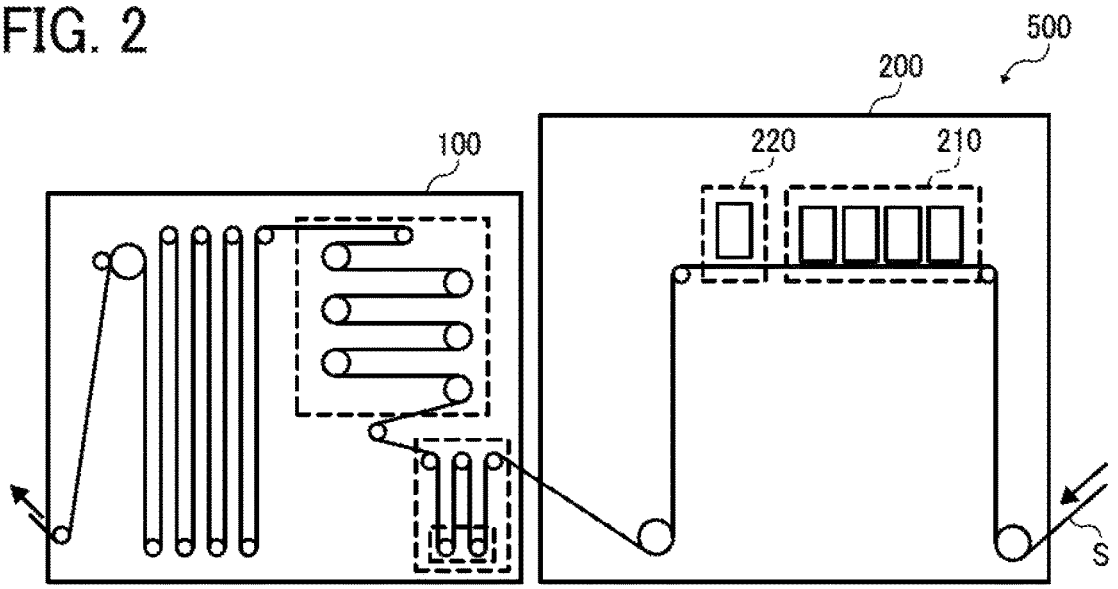
FIG. 2 is a schematic view of a drying system including the drying device illustrated in FIG. 1 according to an embodiment of the present invention.

FIG. 2 is a schematic view of a drying system 500 including the drying device 100.

As illustrated in FIG. 2, the drying device 100 is coupled to a printing device 200 disposed on an upstream side from the drying device 100 relative to the sheet conveyance direction.

The sheet S is conveyed to a printing part 210 in the printing device 200 via a conveyance roller and a guide roller. The printing part 210 includes an inkjet head for discharging ink. The gap between the inkjet head and the sheet S is in the range of about 1 to 2 mm.

The printing device 200 contains a drying part 220 inside.

The drying part 220 is for suppressing the occurrence of picking, not for suppressing the occurrence of blocking. Picking refers to an ink transfer phenomenon which occurs when ink discharged to a printing surface of the sheet S is brought into contact with any of the rollers. In the case of picking, ink transfer occurs even when the contact time of the ink with the roller is short since the ink has not been dried. On the other hand, in the case of blocking, ink has been dried to the degree that the occurrence of picking is suppressed, but ink transfer occurs when the ink is highly pressurized as sheets of recording medium are stacked or wound up.

In the drying system 500, the drying part 220 in the printing device 200 suppresses the occurrence of picking, and the drying device 100 suppresses the occurrence of blocking.

Detailed configurations of the upstream heating rollers 31 and 32 are described below.

Each of the upstream heating rollers 31 and 32 has the same configuration. Accordingly, the following descriptions are made referring to the heating roller 31 disposed at the most upstream position relative to the sheet conveyance direction, for the sake of simplicity. Descriptions for the heating roller 32 disposed at the second upstream position relative to the sheet conveyance direction is omitted.

Figure 3:
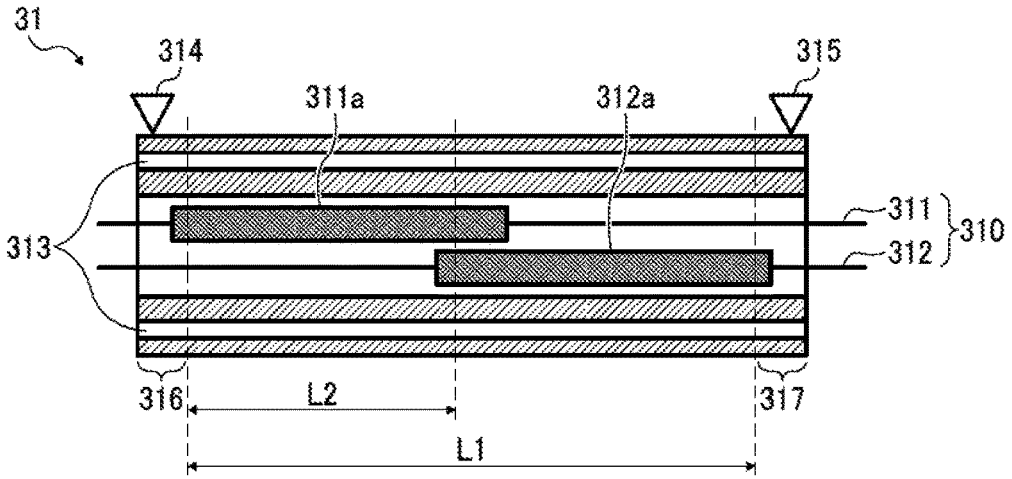
FIG. 3 is a schematic cross-sectional view of an upstream heating roller in the drying device illustrated in FIG. 1.

FIG. 3 is a schematic cross-sectional view of the upstream heating roller 31 in the drying device 100.

The upstream heating roller 31 illustrated in FIG. 3 has a configuration in which the conveyance reference for conveying the sheet S is based on the end part of the sheet S, for an illustrative purpose. The conveyance reference in the drying device 100 is not limited to this configuration.

The upstream heating roller 31 is used for rising the temperature of the sheet S in the drying device 100.

Referring to FIG. 3, the upstream heating roller 31 contains a heat source 310 inside. The heat source 310 includes a first halogen lamp 311 and a second halogen lamp 312. The first halogen lamp 311 serves as a first heat source for heating the conveyance reference side of the upstream heating roller 31. The second halogen lamp 312 serves as a second heat source for heating the other side of the upstream heating roller 31 opposite to the conveyance reference side.

The first halogen lamp 311 has a first light emitting range 311*a*. The second halogen lamp 312 has a second light emitting range 312*a*.

The first light emitting range 311*a* and the second light emitting range 312*a* each have an equivalent heat generating range. The first light emitting range 311*a* and the second light emitting range 312*a* cover different ranges with respect to the width direction of the upstream heating roller 31.

The first light emitting range 311*a* and the second light emitting range 312*a* each have a length approximately equal to half of the length of the heating roller 31 in the axial direction of the upstream heating roller 31. The first light emitting range 311*a* and the second light emitting range 312*a* are overlapped with each other at the central part of the upstream heating roller 31 in the axial direction. The first light emitting range 311*a* and the second light emitting range 312*a* cooperatively cover a maximum sheet width L1 of the sheet S.

The first halogen lamp 311 and the second halogen lamp 312 have different heating ranges but supply the same amount of heat per unit length. Thus, the same amount of heat is symmetrically supplied to both anterior and posterior sides of the upstream heating roller 31. The amount of heat supplied from each of the first halogen lamp 311 and the second halogen lamp 312 at the portion where the first light emitting range 311*a* and the second light emitting range 312*a* are overlapped is half of that at non-overlapped portions where the first light emitting range 311*a* and the second light emitting range 312*a* are not overlapped.

The upstream heating roller 31 contains a heat pipe 313 inside for uniformizing the temperature distribution in the axial direction. Owing to the effect of the heat pipe 313, the upstream heating roller 31 can be uniformly heated from the center to both ends thereof in the axial direction.

The upstream heating roller 31 further includes a first thermopile 314 and a second thermopile 315, each of which being a non-contact temperature sensor, for detecting the surface temperature of the upstream heating roller 31.

The first thermopile 314 serves as a first temperature detector for detecting the temperature of the first halogen lamp 311 based on the surface temperature of the upstream heating roller 31. The second thermopile 315 serves as a second temperature detector for detecting the temperature of the second halogen lamp 312 based on the surface of the upstream heating roller 31.

The first thermopile 314 is disposed facing a non-sheet-passing part 316 on the upstream heating roller 31 through which the sheet S does not pass. In particular, the non-sheet-passing part 316 is on the conveyance-reference-side end of the upstream heating roller 31. The second thermopile 315 is disposed facing another non-sheet-passing part 317 on the upstream heating roller 31 through which the sheet S does not pass. In particular, the non-sheet-passing part 317 is on the other end of the upstream heating roller 31 opposite to the conveyance-reference-side end.

Being non-contact temperature sensors and facing the non-sheet-passing parts on the upstream heating roller 31, the first thermopile 314 and the second thermopile 315 are prevented from being contaminated with fouling, such as paper powder, and thereby prevented from outputting inaccurate values.

Since the temperature is easy to rise in the non-sheet passing parts, the first thermopile 314 and the second thermopile 315 constantly monitor the surface temperatures of the non-sheet-passing part 316 on the conveyance-reference-side end and the non-sheet-passing part 317 on the opposite end, respectively.

In a drying device containing multiple heating rollers, if a sheet having a width narrower than the width of the heat generating range of a halogen lamp (serving as a heat source) is allowed to pass, the following problem may arise. Namely, there may be a danger that the surface temperature of the non-sheet-passing parts is abnormally raised due to the absence of a heat-drawing object and damage peripheral members.

To suppress such temperature rise in the non-sheet-passing parts in the drying device 100 according to an embodiment of the present invention, the first halogen lamp 311 and the second halogen lamp 312, serving as the heat source 310 of the upstream heating roller 31, are controlled by the PC 50 in the following manner.

In accordance with a setting temperature for the upstream heating roller 31, light emission of the first halogen lamp 311 is on-off controlled based on the values output from the first thermopile 314. Similarly, light emission of the second halogen lamp 312 is on-off controlled based on the values output from the second thermopile 315.

Here, the on-off controls of light emissions of the first halogen lamp 311 and the second halogen lamp 312 refer to lighting rate controls of the first halogen lamp 311 and the second halogen lamp 312 for raising the surface temperature of the upstream heating roller 31 to the setting temperature.

In the drying device 100 according to an embodiment of the present invention, the occurrence of temperature rise in the non-sheet-passing parts is suppressed owing to the above-described configuration and control of the upstream heating roller 31.

In the case of conveying a sheet having a maximum width L1, both the first halogen lamp 311 and the second halogen lamp 312 are allowed to emit light to heat the entire area of the upstream heating roller 31 in the axial direction. On the other hand, in the case of conveying a sheet having a minimum width L2, it is likely that the non-sheet-passing part (i.e., the right side in FIG. 3) of the upstream heating roller 31 is heated to a high temperature. Thus, in the case in which the second thermopile 315 detects a high temperature, the second halogen lamp 312 is turned off.

The upstream heating roller 31 according to an embodiment of the present invention is capable of properly heating various types of sheets regardless of their width, thereby preventing the occurrence of excessive temperature rise at the non-sheet-passing parts on the upstream heating roller 31.

A related-art drying device may need a sheet width sensor or a sheet width information input device even when a halogen lamp applicable to sheets of any width is used, or three or more lamps to be applicable to sheets of any width, both of which is costly.

By contrast, the upstream heating roller 31 according to an embodiment of the present invention is applicable to both narrow and wide sheets with only two halogen lamps without any sheet width sensor, which contributes to cost reduction.

The first halogen lamp 311 and the second halogen lamp 312 are independently on-off controllable based on the values output from the first thermopile 314 and the second thermopile 315, respectively.

Detailed configurations of the downstream heating rollers 33 to 36 are described below.

Each of the downstream heating rollers 33 to 36 has the same configuration. Accordingly, the following descriptions are made referring to the heating roller 36 disposed at the most downstream position relative to the sheet conveyance direction, for the sake of simplicity. Descriptions for the other heating rollers 33 to 35 are omitted.

Figure 4:
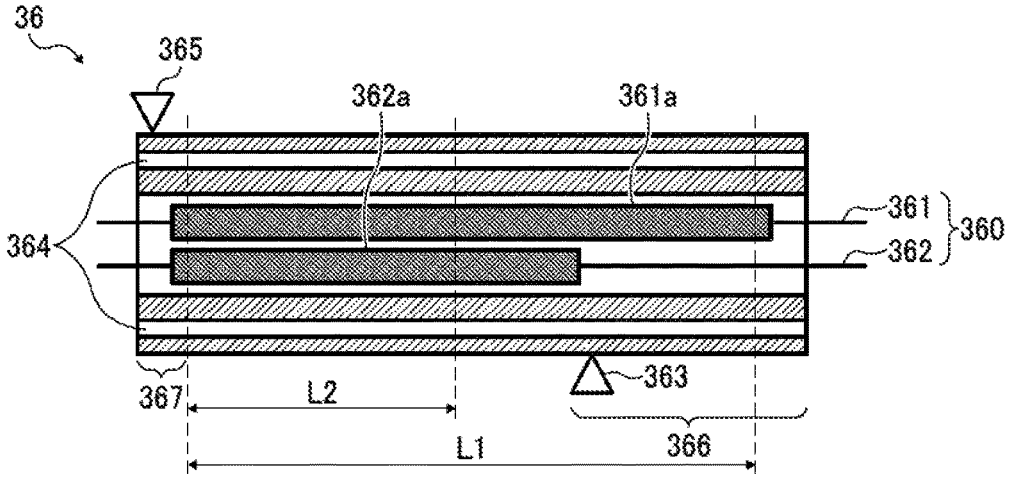
FIG. 4 is a schematic cross-sectional view of a downstream heating roller in the drying device illustrated in FIG. 1.

FIG. 4 is a schematic view of the downstream heating roller 36 in the drying device 100.

The downstream heating roller 36 illustrated in FIG. 4 has a configuration in which the conveyance reference for conveying the sheet S is based on the end part of the sheet S, for an illustrative purpose. The conveyance reference in the drying device 100 is not limited to this configuration.

The downstream heating roller 36 is used for retaining the heat of the sheet S heated by the upstream heating rollers 31 and 32 to dry ink on the sheet S in the drying device 100.

Referring to FIG. 4, the downstream heating roller 36 contains a heat source 360 inside. The heat source 360 includes a third halogen lamp 361 and a fourth halogen lamp 362. The third halogen lamp 361 serves as a third heat source. The fourth halogen lamp 362 serves as a fourth heat source.

The third halogen lamp 361 has a third light emitting range 361*a*. The third light emitting range 361*a* solely covers the maximum sheet width L1 in the axial direction of the downstream heating roller 36.

The fourth halogen lamp 362 has a fourth light emitting range 362*a*. The fourth light emitting range 362*a* solely covers the minimum sheet width L2 in the axial direction of the downstream heating roller 36.

The third halogen lamp 361 and the fourth halogen lamp 362 supply the same amount of heat per unit length.

The downstream heating roller 36 contains a heat pipe 364 inside for uniformizing the temperature distribution in the axial direction. Owing to the effect of the heat pipe 364, the downstream heating roller 36 can be uniformly heated from the center to both ends thereof in the axial direction.

The downstream heating roller 36 further includes a third thermopile 365, being a non-contact temperature sensor, for detecting the surface temperature of the downstream heating roller 36. The third thermopile 365 serves as a third temperature detector for detecting the temperatures of the third halogen lamp 361 and the fourth halogen lamp 362 based on the surface temperature of the downstream heating roller 36.

The third thermopile 365 is disposed facing a non-sheet-passing part 367 on the conveyance-reference-side end on the downstream heating roller 36.

Being a non-contact temperature sensor and facing the non-sheet-passing part 367, the third thermopile 365 is prevented from being contaminated with fouling, such as paper powder, and thereby prevented from outputting inaccurate values.

The downstream heating roller 36 further includes a sheet width sensor 363, serving as a sheet information acquisition device, within the third light emitting range 361*a* where the third halogen lamp 361 emits light when wide sheets are conveyed, and within a non-sheet-passing part 366 through which narrow sheets do not pass.

The third halogen lamp 361 and the fourth halogen lamp 362 in the downstream heating roller 36 are controlled by the PC 50 in the following manner.

First, the to-be-used halogen lamp is selected from one of the third halogen lamp 361 and the fourth halogen lamp 362 in accordance with the width of the sheet detected by the sheet width sensor 363. Specifically, when the sheet width is greater than the distance between the conveyance reference and the position of the sheet width sensor 363 in the axial direction, the third halogen lamp 361 is selected. When the sheet width is smaller than the distance between the conveyance reference and the position of the sheet width sensor 363 in the axial direction, the fourth halogen lamp 362 is selected.

Next, in accordance with a setting temperature for the downstream heating roller 36, light emission of the third halogen lamp 361 or the fourth halogen lamp 362 is on-off controlled based on the values output from the third thermopile 365.

Here, the on-off control of light emission of the third halogen lamp 361 or the fourth halogen lamp 362 refers to a lighting rate control of the third halogen lamp 361 or the fourth halogen lamp 362 for raising the surface temperature of the downstream heating roller 36 to the setting temperature.

In the drying device 100 according to an embodiment of the present invention, the occurrence of temperature rise in the non-sheet-passing parts is suppressed owing to the above-described configuration and control of the downstream heating roller 36.

Specifically, since the to-be-used halogen lamp is properly selected from one of the two halogen lamps 361 and 362 in accordance with the detected sheet width, the non-sheet-passing parts are never exposed to heat. Therefore, the occurrence of temperature rise in the non-sheet-passing parts is suppressed.

In the above-described embodiment, the sheet width sensor 363 is used for controlling the downstream heating roller 36. Alternatively, it is possible to control the downstream heating roller 36 without using the sheet width sensor 363. For example, it is possible to select the third halogen lamp 361 or the fourth halogen lamp 362 to be used in accordance with the sheet width detected by the first thermopile 314 and the second thermopile 315 in the upstream heating roller 31.

The reason that the heat source configuration in each of the downstream heating rollers 33 to 36 is not applied to the upstream heating rollers 31 and 32 is as follows.

As described above, in a conventional drying device containing multiple heating rollers, upstream heating rollers are required to supply a greater amount of heat than downstream heating rollers. Therefore, the upstream heating rollers easily become short of heat. Thus, the upstream heating rollers need a high-power halogen lamp.

On the other hand, it is difficult to produce a high-power halogen lamp having a long light-emitting length. Thus, the upstream heating rollers cannot employ a halogen lamp having a light-emitting length corresponding to the maximum sheet width.

If the heat source configuration in each of the downstream heating rollers 33 to 36 is applied to the upstream heating rollers 31 and 32, the upstream heating rollers 31 and 32 need a halogen lamp having a long light-emitting length corresponding to the maximum sheet width L1 of the sheet S. Thus, the upstream heating rollers 31 and 32 cannot employ a high-power halogen lamp, thereby easily becoming short of heat.

In the above-described embodiment, the upstream heating roller 31 is configured to heat the sheet S having the maximum sheet width L1 with two halogen lamps each having a short light-emitting length. In other words, the upstream heating roller 31 is using the shortest high-power halogen lamps without using a halogen lamp having a long light-emitting length covering the maximum sheet width. Such a halogen lamp having a long light-emitting length is unsuitable for high-power output. Thus, the upstream heating rollers 31 and 32 are capable of supplying a large amount of heat without becoming short of heat.

The reason that the heat source configuration in each of the upstream heating rollers 31 and 32 is not applied to the downstream heating rollers 33 to 36 is as follows.

Namely, the heat source configuration in each of the downstream heating rollers 33 to 36 can more effectively eliminate wasteful heating of the non-sheet-passing parts, thereby lowering power consumption.

Thus, the downstream heating roller 36 is capable of heating a recording medium without wasting electric power while suppressing the occurrence of temperature rise in the non-sheet-passing parts.

In addition, the downstream heating rollers 33 to 36 can use a halogen lamp (heat source) in which the maximum amount of current is flowable. Thus, the downstream heating rollers 33 to 36 are capable of supplying a proper amount of heat without shortening the lifespan of the halogen lamp even when the lighting rate thereof is small.

In the drying device 100 according to an embodiment of the present invention, the heat source configuration in each of the upstream heating rollers 31 and 32 and that in each of the downstream heating rollers 33 to 36 are different.

Specifically, the maximum amount of current flowable in the high-power halogen lamp used in the heat source 310 of the upstream heating roller 31 is greater than that flowable in the halogen lamp used in the heat source 360 of the downstream heating roller 36. Thus, the upstream heating roller 31 is prevented from becoming short of heat.

Since the maximum amount of current flowable in the halogen lamp in the heat source 360 of the downstream heating roller 36 is smaller than that flowable in the halogen lamp in the heat source 310 of the upstream heating roller 31, the downstream heating roller 36 is capable of heating the sheet S without excessively lowering its lighting rate.

Thus, compared to a drying device containing multiple heating rollers each having the same heat source configuration, the drying device 100 can more reliably achieve an optimum heat supply.

In the above-described embodiment, the heat source 310 in the upstream heating roller 31 is controlled using the first thermopile 314 and the second thermopile 315. Alternatively, it is possible to provide a sheet sensor on the upstream heating roller 31 and select the halogen lamp to be used in accordance the detection results from the sheet sensor.

In the above-described embodiment, the heat source 310 in the upstream heating roller 31 has a non-limiting configuration including two halogen lamps. Alternatively, the heat source 310 may include three or more halogen lamps.

Power output of the first halogen lamp 311 and the second halogen lamp 312 in the upstream heating roller 31 is described below.

Figure 5:
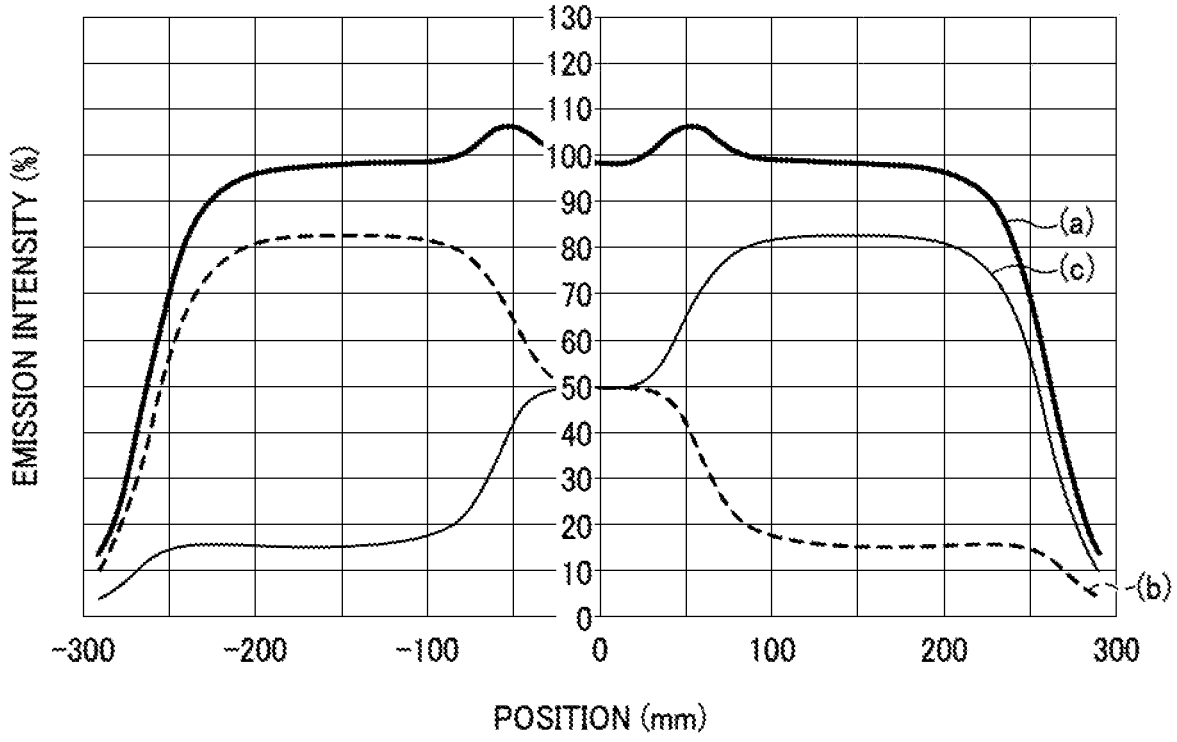
FIG. 5 is a graph showing a relation between the position on the upstream heating roller in the axial direction and emission intensity of halogen lamps.

FIG. 5 is a graph showing a relation between the position on the upstream heating roller 31 in the axial direction and emission intensity of the halogen lamps.

The horizontal axis represents the distance from the center of the upstream heating roller 31 in the axial direction. The vertical axis represents emission intensity.

In the graph, a solid-line curve (a) indicates a heat quantity distribution of the upstream heating roller 31 when both the first halogen lamp 311 and the second halogen lamp 312 are tuned on. A dotted-line curve (b) indicates a heat quantity distribution of the upstream heating roller 31 when only the first halogen lamp 311 is tuned on. A solid-line curve (c) indicates a heat quantity distribution of the upstream heating roller 31 when only the second halogen lamp 312 is tuned on.

As illustrated in FIG. 5, emission intensity distributions of the first halogen lamp 311 and the second halogen lamp 312 are asymmetrical with respect to a line crossing the center of the upstream heating roller 31 in the axial direction and perpendicular to the axial direction. The solid-line curve (a) indicates that the upstream heating roller 31 is capable of giving an almost constant amount of heat in the axial direction thereof when both the first halogen lamp 311 and the second halogen lamp 312 are tuned on.

Next, temperature distribution of the surface of the upstream heating roller 31, disposed on the most upstream position relative to the sheet conveyance direction, and that of the sheet S are described below.

Figure 6:
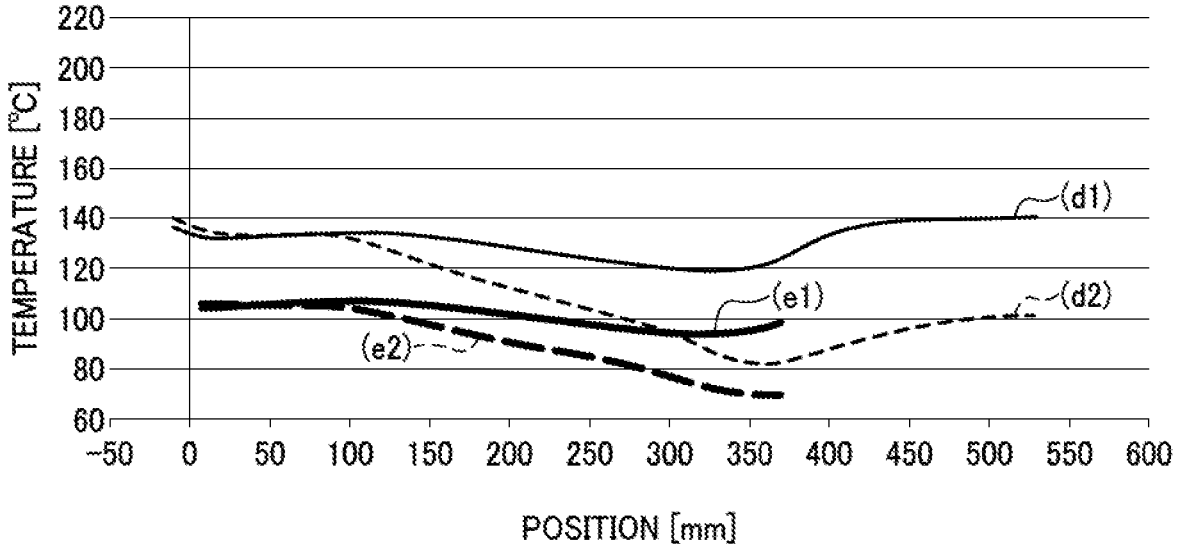
FIG. 6 is a graph showing a relation among the surface temperature of the upstream heating roller, the temperature of a sheet conveyed, and the position on the upstream heating roller in the axial direction, when the sheet is a narrow-width sheet.

FIG. 6 is a graph showing a relation among the surface temperature of the upstream heating roller 31, the temperature of the sheet S, and the position on the upstream heating roller 31 in the axial direction, when the sheet S is a narrow-width sheet.

The horizontal axis represents the position on the upstream heating roller 31 in the axial direction. The vertical axis represents the temperatures of the surface of the upstream heating roller 31 and the sheet S. In the graph, thin-line curves (d1) and (d2) each indicate a temperature distribution of the surface of the upstream heating roller 31, and thick-line curves (e1) and (e2) each indicate a temperature distribution of the sheet S. The solid-line curves (d1) and (e1) each represent a case in which both the first halogen lamp 311 and the second halogen lamp 312 in the upstream heating roller 31 are turned on and the surface temperature of the upstream heating roller 31 is controlled to 140° C. The dotted-line curves (d2) and (e2) each represent a case in which only the first halogen lamp 311 is turned on.

The graph illustrated in FIG. 6 is a simulation result with respect to temperature distributions of the surface of the upstream heating roller 31 and the sheet S at 120 seconds after the start of conveyance of the sheet S, in the case in which the axial length of the upstream heating roller 31 is 540 mm and the width of the sheet S is 380 mm. The simulation calculation is performed under a prerequisite that the initial temperature of the sheet is 40° C. and the standby temperature of the upstream heating roller 31 is 140° C.

As shown by the dotted-line curve (e2) in FIG. 6, when only the first halogen lamp 311 is turned on, the temperature distribution of the sheet S has a maximum temperature difference of about 40° C. in the sheet width direction (i.e., axial direction of the upstream heating roller 31). On the other hand, as shown by the solid-line curve (e1) in FIG. 6, when both the first halogen lamp 311 and the second halogen lamp 312 are turned on, the temperature distribution of the sheet S has a temperature difference of about only 10° C. in the sheet width direction.

In the drying device 100 according to an embodiment of the present invention, the upstream heating roller 31 is temperature-controlled by the first thermopile 314 and the second thermopile 315 disposed facing the non-sheet-passing parts. Owing to the temperature control, even when the temperature of the non-sheet-passing part is more raised than that of the sheet-passing part on the upstream heating roller 31, as shown by the solid-line curve (d1) and the dotted-line curve (d2), peripheral members are not damaged.

Figure 7:
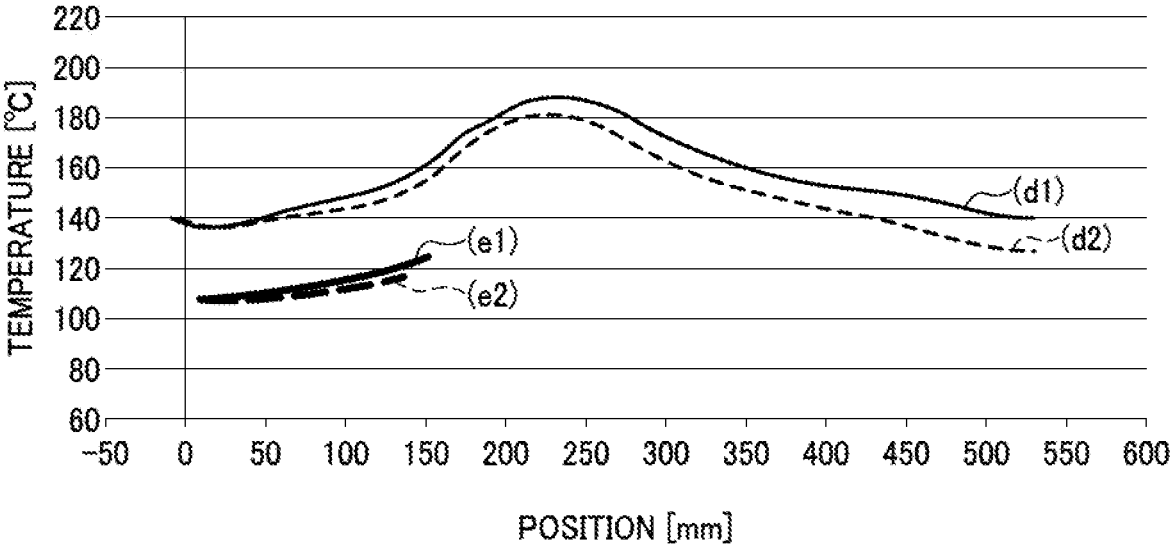
FIG. 7 is a graph showing a relation among the surface temperature of the upstream heating roller, the temperature of a sheet conveyed, and the position on the upstream heating roller in the axial direction, when the sheet is another sheet having a much narrower width than that used in FIG. 6.

FIG. 7 is a graph showing a relation among the surface temperature of the upstream heating roller 31, the temperature of the sheet S, and the position on the upstream heating roller 31 in the axial direction, when the sheet S is another narrow-width sheet having a much narrower width than that used in FIG. 6.

The horizontal axis represents the position on the upstream heating roller 31 in the axial direction. The vertical axis represents the temperatures of the surface of the upstream heating roller 31 and the sheet S.

In the graph, thin-line curves (d1) and (d2) each indicate a temperature distribution of the surface of the upstream heating roller 31, and thick-line curves (e1) and (e2) each indicate a temperature distribution of the sheet S. The solid-line curves (d1) and (e1) each represent a case in which both the first halogen lamp 311 and the second halogen lamp 312 in the upstream heating roller 31 are turned on and the surface temperature of the upstream heating roller 31 is controlled to 140° C. The dotted-line curves (d2) and (e2) each represent a case in which only the first halogen lamp 311 is turned on.

The graph illustrated in FIG. 7 is a simulation result with respect to temperature distributions of the surface of the upstream heating roller 31 and the sheet S, calculated under the same condition and prerequisite in obtaining the graph illustrated in FIG. 6 expect for changing the width of the sheet S to 160 mm.

Referring to FIG. 7, the temperature distribution of the sheet S when both the first halogen lamp 311 and the second halogen lamp 312 are turned on (shown by the solid-line curve (e1)) and that when only the first halogen lamp 311 is tuned on (shown by the dotted-line curve (e2)) are almost equal. This is because the width of the sheet S is almost same as the width of the first halogen lamp 311 in the axial direction.

With respect to the temperature distribution of the surface of the upstream heating roller 31, the temperature difference between the case in which both the first halogen lamp 311 and the second halogen lamp 312 are tuned on (shown by the solid-line curve (d1)) and the other case in which only the first halogen lamp 311 is turned on (shown by the dotted-line curve (d2)) is less than 10° C. Thus, even when both the first halogen lamp 311 and the second halogen lamp 312 are turned on when conveying narrow-width sheets, temperature rise in the non-sheet-passing parts can be suppressed. Therefore, the upstream heating roller 31 containing the combination of the first halogen lamp 311 and the second halogen lamp 312 is applicable to various types of sheets without using a sheet width sensor.

Control of the first halogen lamp 311 and the second halogen lamp 312 in the upstream heating roller 31 by thermopile is described below.

Figure 8:
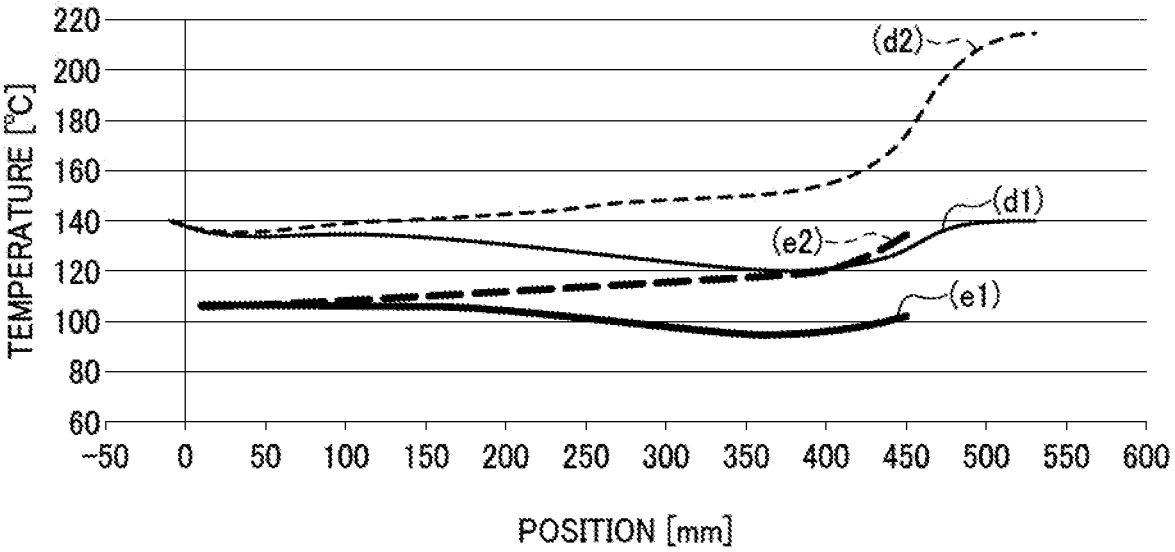
FIG. 8 is a graph showing a relation among the surface temperature of the upstream heating roller, the temperature of a sheet conveyed, and the position on the upstream heating roller in the axial direction, when halogen lamps are controlled by thermopile.

FIG. 8 is a graph showing a relation among the surface temperature of the upstream heating roller 31, the temperature of the sheet S, and the position on the upstream heating roller 31 in the axial direction, when the halogen lamps are controlled by thermopile.

The horizontal axis represents the position on the upstream heating roller 31 in the axial direction. The vertical axis represents the temperatures of the surface of the upstream heating roller 31 and the sheet S.

In the graph, thin-line curves (d1) and (d2) each indicate a temperature distribution of the surface of the upstream heating roller 31, and thick-line curves (e1) and (e2) each indicate a temperature distribution of the sheet S. The solid-line curves (d1) and (e1) each represent a case in which the first halogen lamp 311 and the second halogen lamp 312 are independently controlled by the first thermopile 314 and the second thermopile 315, respectively (hereinafter "independent control"). The dotted-line curves (d2) and (e2) each represent a case in which the first halogen lamp 311 and the second halogen lamp 312 are interlocked to be simultaneously controlled only by the first thermopile 314 (hereinafter "interlocking control").

The graph illustrated in FIG. 8 is a simulation result with respect to temperature distributions of the surface of the upstream heating roller 31 and the sheet S at 120 seconds after the start of conveyance of the sheet S, in the case in which the axial length of the upstream heating roller 31 is 540 mm and the width of the sheet S is 480 mm. The simulation calculation is performed under a prerequisite that the initial temperature of the sheet is 40° C. and the standby temperature of the upstream heating roller 31 is 140° C.

In the interlocking control of the first halogen lamp 311 and the second halogen lamp 312, as shown by the dotted-line curve (d2), the surface temperature of the upstream heating roller 31 is sharply raised at the non-sheet-passing part. On the other hand, in the independent control of the first halogen lamp 311 and the second halogen lamp 312, as shown by the solid-line curve (d1), the surface temperature of the upstream heating roller 31 at the non-sheet-passing part is raised only to 140° C. The degree of temperature rise in the non-sheet-passing part is smaller than that in the interlocking control.

With respect to the temperature of the sheet S, in the interlocking control of the first halogen lamp 311 and the second halogen lamp 312, as shown by the dotted-line curve (e2), a temperature difference of about 30° C. is generated between both ends of the sheet in the width direction.

On the other hand, in the independent control of the first halogen lamp 311 and the second halogen lamp 312, as shown by the solid-line curve (e1), the temperature difference between both ends of the sheet in the width direction is only about 10° C., which is smaller than that in the interlocking control.

To improve printing quality, the temperature difference in a single plane is preferably as small as possible. Accordingly, the independent control of the first halogen lamp 311 and the second halogen lamp 312 is more preferable to improve printing quality.

Control of the drying device 100 in accordance with an embodiment of the present invention is described below.

Figure 9:
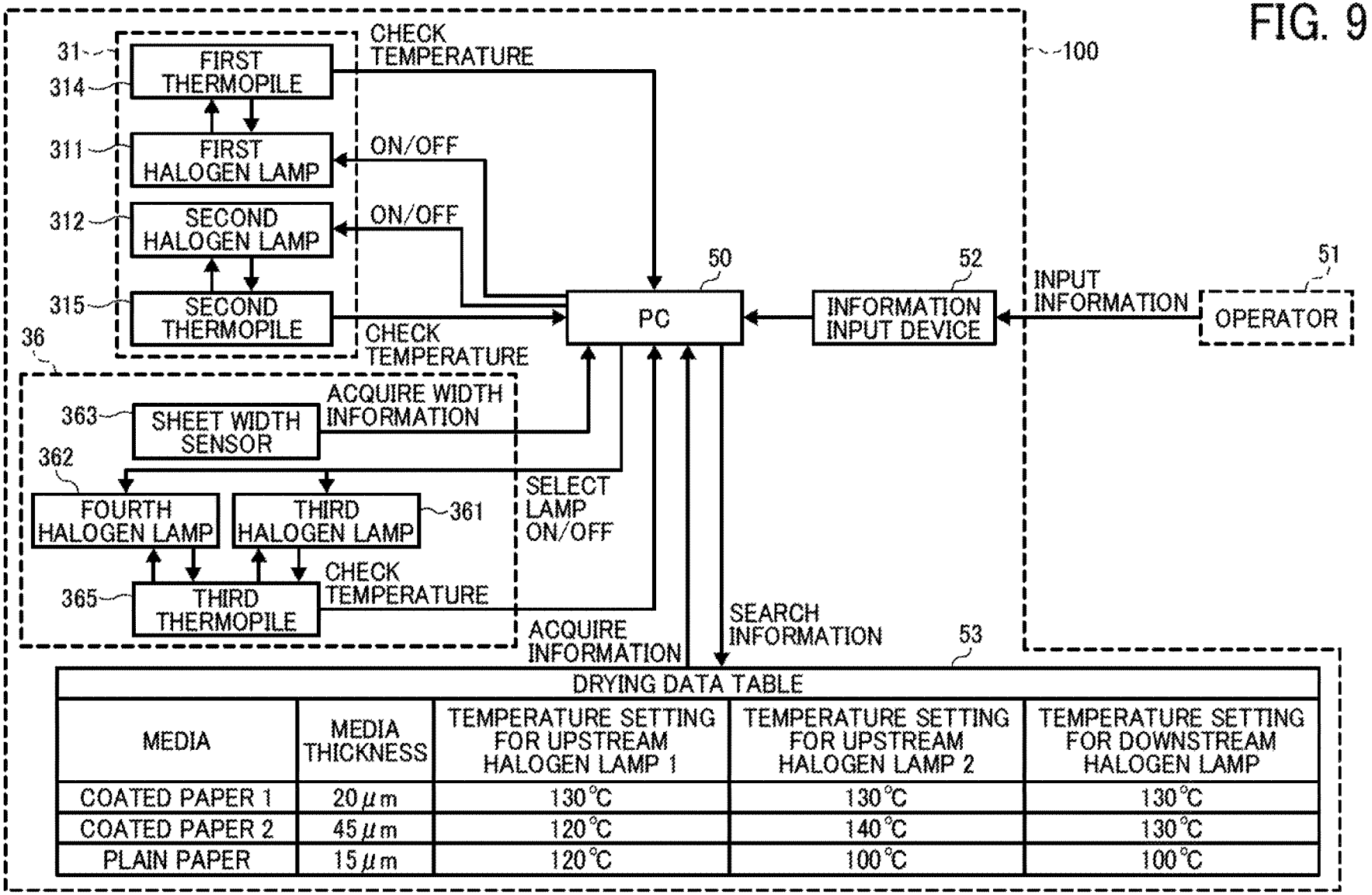
FIG. 9 is a schematic diagram illustrating a control of the drying device illustrated in FIG. 1.

FIG. 9 is a schematic diagram illustrating a control of the drying device 100.

Each of the upstream heating rollers 31 and 32 has the same configuration and is coupled to the PC 50 and controlled by the PC 50. Accordingly, the following descriptions are made referring to the heating roller 31 disposed at the most upstream position relative to the sheet conveyance direction, for the sake of simplicity. Descriptions for the heating roller 32 disposed at the second upstream position relative to the sheet conveyance direction is omitted.

Each of the downstream heating rollers 33 to 36 has the same configuration and is coupled to the PC 50 and controlled by the PC 50. Accordingly, the following descriptions are made referring to the heating roller 36 disposed at the most downstream position relative to the sheet conveyance direction, for the sake of simplicity. Descriptions for the other heating rollers 33 to 35 are omitted.

As illustrated in FIG. 9, the PC 50, serving as a controller, is coupled to the first thermopile 314, the first halogen lamp 311, the second thermopile 315, and the second halogen lamp 312, each of which included in the upstream heating roller 31. The PC 50 is also coupled to the third thermopile 365, the third halogen lamp 361, the fourth halogen lamp 362, and the sheet width sensor 363, each of which included in the downstream heating roller 36.

The PC 50 is also coupled to an information input device 52 for inputting information on the recording medium and a data table 53 to which proper temperature setting information for various sheet has been input.

The drying device 100 is controlled by the PC 50 in the following manner.

First, an operator 51 selects a sheet to be used through the information input device 52, and information on the sheet is input to the PC 50. Based on the input information, the PC 50 acquires proper temperature setting information for each of the heating rollers 31 to 36 from the data table 53.

Based on the temperature setting information, the halogen lamps included in the upstream heating rollers 31 and 32 and the downstream heating rollers 33 to 36 are on-off controlled so that the surface temperatures of the heating rollers 31 to 36 are adjusted to the setting temperatures. With respect to each of the downstream heating rollers 33 to 36, the PC 50 selects the third halogen lamp 361 or the fourth halogen lamp 362 to be used in accordance with information from the sheet width sensor 363.

If the data table contains no information, the operator can register setting values therein.

Owing to this control, the drying device 100 can set an optimum amount of heat supply for each type of sheet.

The conveyance speed and the drying temperature during printing operation are described below.

Figure 10:
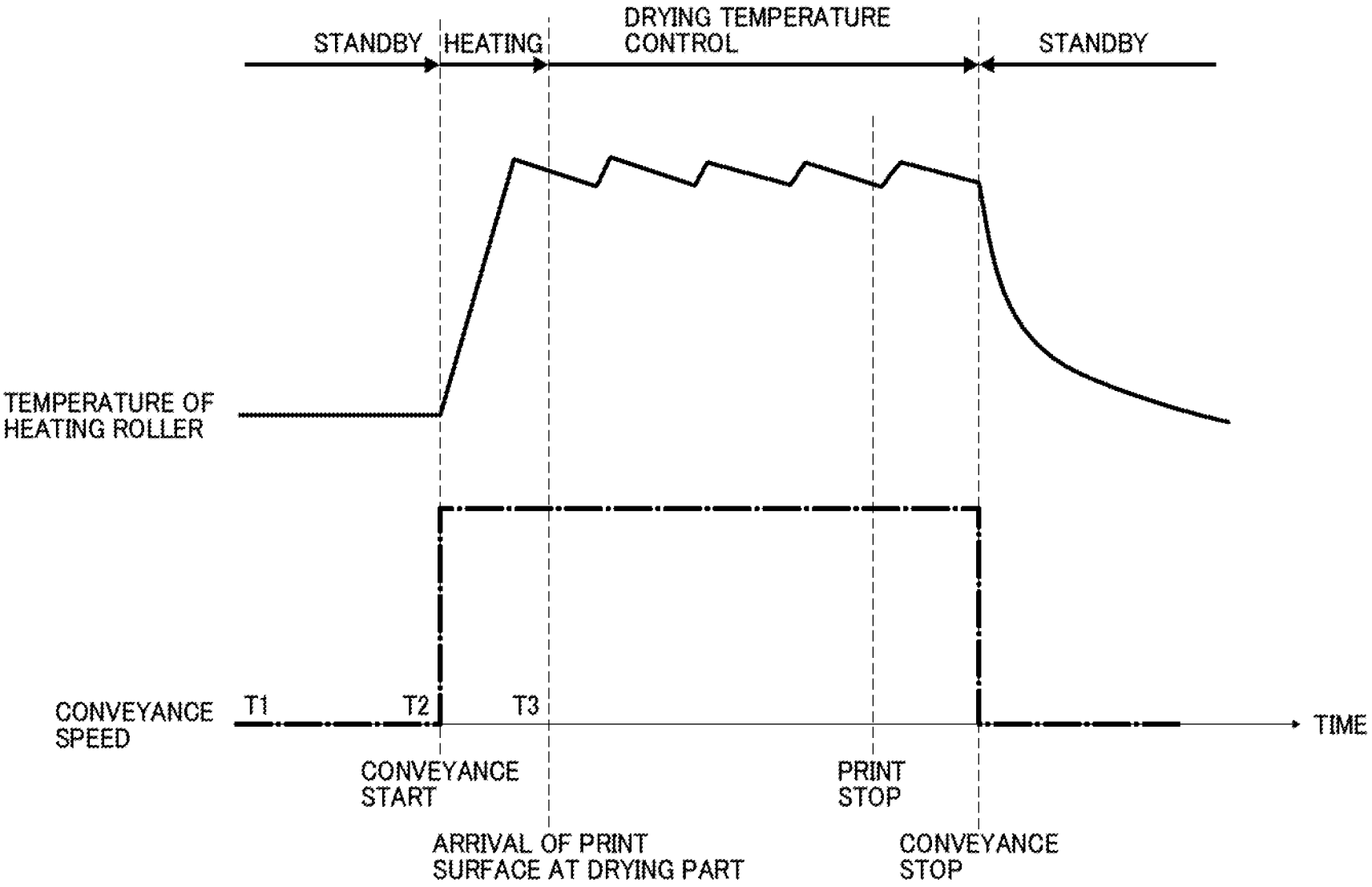
FIG. 10 is a graph showing a relation between the elapsed time and the temperature of heating rollers in the drying device illustrated in FIG. 1.

FIG. 10 is a graph showing a relation between the elapsed time and the temperature of the heating rollers.

The horizontal axis represents the time elapsed from the start of conveyance of the sheet S to the drying device 100. The vertical axis represents the temperature and conveyance speed of the heating rollers. The upper parts of the vertical axis represent higher temperatures and higher conveyance speeds.

At a time T1 before the printing device 200 starts printing image on the sheet S, the heating rollers 31 to 36 in the drying device 100 are controlled to have a standby temperature. At a time T2 when the printing on the sheet S starts, the drying device 100 heats the heating rollers 31 to 36 to a predetermined drying temperature.

Since there is a certain distance between the printing device 200 and the sheet drying part 30 of the drying device 100, there is a time lag between the time when the heating rollers 31 to 36 reach the predetermined drying temperature and the time when the sheet S having an image thereon arrives at the sheet drying part 30 of the drying device 100. In the drying system 500 according to an embodiment of the present invention, the time lag is about 1 minutes when the conveyance speed is 50 m/min.

At a time T3 when the print surface of the sheet S has arrived at the sheet drying part 30 of the drying device 100, the surface temperatures of the heating rollers 31 to 36 have already reached the targeted temperature.

Thus, since heating of the heating rollers 31 to 36 in the drying device 100 is started after the start of convaeyance of the sheet S, power consumption is reduced without wasting heat.

The above-described embodiments of the present invention are summarized below.

Embodiment A

The drying device 100 according to embodiment A includes the multiple heating rollers 31 to 36 for drying a recording medium, such as the sheet S, wound around the heating rollers 31 to 36 while conveying the recording medium. The upstream heating rollers 31 and 32, disposed on an upstream side relative to a direction of conveyance of the recording medium, each include an upstream heat source (e.g., heat source 310). The downstream heating rollers 33 to 36, disposed on a downstream side from the upstream heat rollers 31 and 32 relative to the direction of conveyance of the recording medium, each include a downstream heat source (e.g., heat source 360). The upstream heat source (e.g., heat source 310) and the downstream heat source (e.g., heat source 360) have different configurations. The upstream heat source (e.g., heat source 310) has a maximum amount of current greater than that of the downstream heat source (e.g., heat source 360).

In this embodiment, the maximum amount of current flowable in the high-power halogen lamp used in the heat source 310 of the upstream heating roller 31 is greater than that flowable in the halogen lamp used in the heat source 360 of the downstream heating roller 36. Thus, the upstream heating roller 31 is prevented from becoming short of heat.

Since the maximum amount of current flowable in the halogen lamp in the heat source 360 of the downstream heating roller 36 is smaller than that flowable in the halogen lamp in the heat source 310 of the upstream heating roller 31, the downstream heating roller 36 is capable of heating the sheet S without excessively lowering its lighting rate.

Thus, compared to a drying device containing multiple heating rollers each having the same heat source configuration, the drying device 100 can more reliably achieve an optimum heat supply.

Embodiment B

According to Embodiment B, in addition to the configuration of Embodiment A, the upstream heat source (e.g., heat source 310) includes a first heat source (e.g. first halogen lamp 311) having a first heat generating range (e.g., first light emitting range 311*a*) and a second heat source (e.g., second halogen lamp 312) having a second heat generating range (e.g., second light emitting range 312*a*). The first heat generating range (e.g., first light emitting range 311*a*) and the second heat generating range (e.g., second light emitting range 312*a*) cover different ranges with respect to a width direction of the upstream heating rollers 31 and 32 to cover a first width L1 of the recording medium. The downstream heat source (e.g., heat source 360) includes a third heat source (e.g., third halogen lamp 361) having a third light generating range (e.g., third light emitting range 361*a*) solely covering the first width L1 of the recording medium.

In this embodiment, the upstream heating roller 31 is configured to heat the sheet S having the maximum sheet width L1 with two halogen lamps each having a short light-emitting length. The upstream heating roller 31 supplies heat to the recording medium using two high-power halogen lamps. Thus, the upstream heating rollers 31 and 32 are capable of supplying a large amount of heat without becoming short of heat.

In addition, since the downstream heating roller 36 supplies heat using only one halogen lamp in accordance with the sheet width, the downstream heating roller 36 can use a halogen lamp in which the maximum amount of current suitable for the downstream heating roller 36 is flowable. Accordingly, the downstream heating roller 36 is capable of heating the sheet S without excessively lowering its lighting rate.

Embodiment C

According to Embodiment C, in addition to the configuration of Embodiment B, the drying device 100 further includes a controller (e.g., PC 50) to control the heat source 310 and the heat source 360. Each of the upstream heating rollers 31 and 32 further includes a first temperature detector (e.g., first thermopile 314) to detect a temperature of the first heat source (e.g., first halogen lamp 311) and a second temperature detector (e.g., second thermopile 315) to detect a temperature of the second heat source (e.g., second halogen lamp 312). The downstream heat source (e.g., heat source 360) further includes a fourth heat source (e.g., fourth halogen lamp 362) having a fourth heat generating range (e.g., fourth light emitting range 362*a*) solely covering a second width L2 of the recording medium. Each of the downstream heating rollers 33 to 36 further includes a third temperature detector (e.g., third thermopile 365) to detect temperatures of the third heat source (e.g., third halogen lamp 361) and the fourth heat source (e.g., fourth halogen lamp 362). The controller (e.g., PC 50) controls the first heat source (e.g., first halogen lamp 311) and the second heat source (e.g., second halogen lamp 312) based on a detection result from the first temperature detector (e.g., first thermopile 314), and controls the third heat source (e.g., third halogen lamp 361) based on a detection result from the second temperature detector (e.g., second thermopile 315).

In this embodiment, the first halogen lamp 311 and the second halogen lamp 312 in the upstream heating roller 31 are controlled as follows.

In the case of conveying a sheet having a maximum width L1, both the first halogen lamp 311 and the second halogen lamp 312 are allowed to emit light to heat the entire area of the upstream heating roller 31 in the axial direction. On the other hand, in the case of conveying a sheet having a minimum width L2, it is likely that the non-sheet-passing part (i.e., the right side in FIG. 3) of the upstream heating roller 31 is heated to a high temperature. Thus, in the case in which the second thermopile 315 detects a high temperature, the second halogen lamp 312 is turned off. The upstream heating roller 31 is capable of properly heating various types of sheets regardless of their width, thereby preventing the occurrence of excessive temperature rise at the non-sheet-passing parts on the upstream heating roller 31.

The upstream heating roller 31 is applicable to both narrow and wide sheets with using only two halogen lamps without using any sheet width sensor, which contributes to cost reduction.

In the downstream heating roller 36, since the to-be-used halogen lamp is properly selected from one of the two halogen lamps 361 and 362 in accordance with the detected sheet width, the non-sheet-passing parts are never exposed to heat. Therefore, the occurrence of temperature rise in the non-sheet-passing parts is suppressed.

Namely, the heat source configuration in each of the downstream heating rollers 33 to 36 can more effectively eliminate wasteful heating of the non-sheet-passing parts, thereby lowering power consumption.

Embodiment D

According to Embodiment D, in addition to the configuration of Embodiment C, each of the first temperature detector (e.g., first thermopile 314), the second temperature detector (e.g., second thermopile 315), and the third temperature detector (e.g., third thermopile 365) is a non-contact temperature sensor. Each of the first temperature detector (e.g., first thermopile 314) and the second temperature detector (e.g., second thermopile 315) is disposed facing the non-sheet-passing part 316 or 317 on each of the upstream heating rollers 31 and 32. The third temperature detector (e.g., third thermopile 365) is disposed facing the non-sheet-passing part 367 on each of the downstream heating rollers 33 to 36.

In this embodiment, the non-contact temperature sensors are prevented from being contaminated with fouling, such as paper powder, and thereby prevented from outputting inaccurate values.

Embodiment E

According to Embodiment E, in addition to the configuration of Embodiment C or D, the drying device 100 further includes an input device (e.g., information input device 52) to input information of the recording medium (e.g., sheet S) or an acquisition device (e.g., sheet width sensor 363) to acquire information of the recording medium from peripheral devices.

In this embodiment, the drying device 100 can set an optimum amount of heat supply for each type of sheet.

Embodiment F

According to Embodiment F, in addition to the configuration of any of Embodiments C to E, the drying device further includes an input device to determine a heating temperature and a heating time for each of the heating rollers 31 to 16 based on information of the recording medium (e.g., sheet S).

In this embodiment, the heating rollers are prevented from becoming short of heat or being excessively supplied with heat.

Embodiment G

According to Embodiment G, in addition to the configuration of any of Embodiments C to F, the controller (e.g., PC 50) performs a control in which surface temperatures of the heating rollers 31 to 36 are raised from a standby temperature to a target temperature, after a start of conveyance of the recording medium (e.g., sheet S) and before an arrival of the recording medium at the heating rollers 31 to 36.

In this embodiment, power consumption is lowered since heating is not performed before the start of printing.

Embodiment H

A recording medium drying system (e.g., drying system 500) according to Embodiment H includes a pretreatment device (e.g., printing device 200) to apply an ink or a pretreatment liquid to the recording medium (e.g., sheet S) and the drying device 100 according to any of Embodiments A to G to dry the recording medium. The drying device 100 is disposed downstream from the pretreatment device (e.g., printing device 200) relative to the direction of conveyance of the recording medium.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. A drying device, comprising:

a plurality of heating rollers to heat a recording medium wound around the heating rollers while conveying the recording medium, the plurality of heating rollers including a plurality of upstream heating rollers each including a first heat source and a second heat source, and a plurality of downstream heating rollers each disposed downstream of the plurality of upstream heating rollers in a direction of conveyance of the recording medium, each downstream heating roller including a third heat source wherein each of the upstream heating rollers has an overall internal configuration of heaters that is different from an overall internal configuration of heaters in each of the downstream heating rollers; and a controller configured to individually control power to the first, second, and third heat sources so that each upstream heating roller supplies a greater amount of heat than each downstream heating roller, no heating roller that supplies a lower amount of heat than the upstream heating rollers is disposed between the plurality of upstream heating rollers in the direction of conveyance of the recording medium, and no heating roller that supplies a greater amount of heat than the downstream heating rollers is disposed between the plurality of downstream heating rollers in the direction of conveyance of the recording medium, wherein the first heat source has a first heat generating range and the second heat source has a second heat generating range, the first heat generating range and the second heat generating range covering different ranges with respect to a width direction of the upstream heating rollers, and the third heat source has a third heat generating range, and the third heat generating range is different than that of each of the first heat generating range and the second heat generating range.

2. The drying device according to claim 1, wherein, in each upstream heating roller, the first heat source and the second heat source are disposed at different respective positions along the direction of conveyance of the recording medium, wherein each upstream heating roller further includes a first temperature detector to detect a temperature of the respective first heat source, and a second temperature detector to detect a temperature of the respective second heat source, wherein each downstream heating roller further includes a fourth heat source having a fourth heat generating range different from the third heat generating range, in the axial direction of the downstream heating roller, and a third temperature detector to detect temperatures of the third heat source and the fourth heat source, and wherein the controller is further configured to control each first heat source based on a detection result from the respective first temperature detector, and control each second heat source based on a detection result from the respective second temperature detector.

3. The drying device according to claim 2, wherein each of the first temperature detector, the second temperature detector, and the third temperature detector is a non-contact temperature sensor, wherein each of the first temperature detector and the second temperature detector are each disposed to face a respective non-sheet-passing part of the respective upstream heating roller, and wherein each third temperature detector is disposed facing non-sheet-passing part on the respective downstream heating roller.

4. The drying device according to claim 2, further comprising an input device to input information of the recording medium or an acquisition device to acquire information of the recording medium from peripheral devices.

5. The drying device according to claim 2, further comprising an input device to determine a heating temperature and a heating time for each of the upstream heating rollers and downstream heating rollers based on information of the recording medium.

6. The drying device according to claim 2, wherein the controller is further configured to perform a control process in which surface temperatures of each of the upstream heating rollers and downstream heating rollers are raised from a standby temperature to a target temperature, after a start of conveyance of the recording medium and before an arrival of the recording medium at the upstream heating rollers.

7. A recording medium drying system, comprising:

a pretreatment device to apply an ink or a pretreatment liquid to a recording medium; and the drying device according to claim 1 to dry the recording medium, the drying device being disposed downstream from the pretreatment device relative to the direction of conveyance of the recording medium.

8. The driving device according to claim 1, wherein the first heat source and the second heat source are disposed inside the respective upstream heating roller at different respective positions along the direction of conveyance of the recording medium, and wherein each of the first heat generating range and the second heat generating range has a length approximately equal to half of a length of the respective upstream heating roller in the axial direction of the upstream heating roller.

9. The drying device according to claim 1, wherein the first heat source and the second heat source are disposed inside the respective upstream heating roller at different respective positions along the direction of conveyance of the recording medium, the first heat generating range extending from one end portion of the respective upstream heating roller to a central portion of the respective upstream heating roller, in an axial direction of the upstream heating roller, and the second heat generating range extending from another end portion of the respective upstream heating roller to the central portion of the respective upstream heating roller, in the axial direction, and wherein the first heat generating range and the second heat generating range are disposed to overlap with each other at the central portion of the respective upstream heating roller in the axial direction, and wherein the first heat generating range, and not the second heat generating range, is disposed at the one end portion of the respective upstream heating roller in the axial direction, and the second heat generating range, and not the first heat generating range, is disposed at said another end portion of the respective upstream heating roller in the axial direction.

10. The drying device according to claim 2, wherein each downstream heating roller further includes a sheet width sensor that senses a width of the recording medium, and wherein the controller is further configured to control each third heat source and each fourth heat source based on a detection result of the respective sheet width sensor.

11. A drying device, comprising:

a plurality of heating rollers to heat a recording medium wound around the heating rollers while conveying the recording medium, the plurality of heating rollers including a plurality of upstream heating rollers each including a first heat source and a second heat source, and a plurality of downstream heating rollers each disposed downstream of the plurality of upstream heating rollers in a direction of conveyance of the recording medium, each downstream heating roller including a third heat source, wherein each of the upstream heating rollers has an overall internal configuration of heaters that is different from an overall internal configuration of heaters in each of the downstream heating rollers; and a controller configured to individually control power to the first, second, and third heat sources so that each upstream heating roller supplies a greater amount of heat than each downstream heating roller, wherein the plurality of upstream heating rollers are consecutively arranged along the direction of conveyance of the recording medium, wherein the plurality of downstream heating rollers are consecutively arranged along the direction of conveyance of the recoding medium, wherein the first heat source has a first heat generating range and the second heat source has a second heat generating range, the first heat generating range and the second heat generating range covering different ranges with respect to a width direction of the upstream heating rollers, and the third heat source has a third heat generating range, and the third heat generating range is different than that of each of the first heat generating range and the second heat generating range.

12. The drying device according to claim 1, wherein each downstream heat source further contains a fourth heat source having a fourth heat generating range, the fourth heat generating range has a length greater than that of each of the first heat generating range and the second heat generating range and smaller than that of the third heat generating range.

13. The drying device according to claim 1, wherein, when a recording medium having a maximum width is being conveyed, the controller is further configured to:

control the upstream heat sources to heat the recording medium by both the first heat generating range and the second heat generating range, and control the downstream heat sources to heat the recording medium by the third heat generating range.

14. The drying device of claim 1, wherein the third heat generating range covers a same range in the width direction as a combined range of the first and second heat generating ranges.

* * * * *